US010103481B2

(12) United States Patent
Graham et al.

(10) Patent No.: US 10,103,481 B2
(45) Date of Patent: Oct. 16, 2018

(54) CONNECTOR WITH CONNECTOR POSITION ASSURANCE

(71) Applicant: J.S.T. Corporation, Farmington Hills, MI (US)

(72) Inventors: Zachary Graham, Grosse Pointe Park, MI (US); Eric Blankinship, Farmington Hills, MI (US); Gwendolyn Upson, Ypsilanti, MI (US); Ping Chen, Farmington Hills, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 0 days.

(21) Appl. No.: 15/552,290

(22) PCT Filed: Feb. 20, 2015

(86) PCT No.: PCT/US2015/016979
§ 371 (c)(1),
(2) Date: Aug. 20, 2017

(87) PCT Pub. No.: WO2016/133548
PCT Pub. Date: Aug. 25, 2016

(65) Prior Publication Data
US 2018/0048092 A1 Feb. 15, 2018

(51) Int. Cl.
*H01R 13/627* (2006.01)
*H01R 13/50* (2006.01)

(52) U.S. Cl.
CPC ..... *H01R 13/6272* (2013.01); *H01R 13/501* (2013.01)

(58) Field of Classification Search
CPC ..... H01R 13/506; H01R 13/6272; H01R 13/6275; H01R 13/6273
USPC ..... 439/351, 354, 357, 358
See application file for complete search history.

(56) References Cited

U.S. PATENT DOCUMENTS 5,653,613 A * 8/1997 Shimoda ..... H01R 13/4361 439/752
5,928,034 A * 7/1999 Tabata ..... H01R 13/4365 439/595
6,004,158 A * 12/1999 Ward ..... H01R 13/4361 439/595
2016/0248188 A1* 8/2016 Upson ..... H01R 13/4361

* cited by examiner

*Primary Examiner* — Phuong Chi T Nguyen
(74) *Attorney, Agent, or Firm* — Myers Bradford, PLLC

(57) ABSTRACT

A system and method are described for improved connector position assurance. A latch stop mechanism (10) on a first connector may be used to selectively limit movement of a latch (50) and attached latch lock (54) after the latch lock (54) has been engaged to secure the first connector (2) to a second connector (1). The latch stop (10) mechanism may be attached to the connector housing (80) and have a series of hinges (12), (16) that allow a latch stop (10) to pivot into place, limiting movement of the latch (50) and latch lock (54).

19 Claims, 10 Drawing Sheets

CONNECTOR WITH CONNECTOR POSITION ASSURANCE

TECHNICAL FIELD

A system and method are described for providing improved connector position assurance. This invention relates especially to electrical connectors and connector position assurance, and also to connector systems that may have a terminal, a female connector, and a male connector. The invention further relates to methods for connecting using the improved connector position assurance of the present invention.

BACKGROUND ART

Numerous connector systems have been developed, and especially relating to electrical connectors. It is common to have male and female connector portions. Various locking mechanisms have been devised to secure connectors in a connected position. These may include generally, the use of a latch member. Latch securing methods have been previously investigated, including sliding latch securing mechanisms. However, it is believed that hinged options so far have not been available to practically and reliably secure a latch, especially where a latch stop is attached to a connector housing such that it may pivot into the connector to secure a latch.

DISCLOSURE OF THE INVENTION

The present invention is intended to provide improved connector position assurance that may be used to secure engagement between a first and second connector. A latch stop mechanism on a first connector may be used to selectively limit movement of a latch and an attached latch lock after the latch lock has been engaged to secure the first connector to the second connector. The latch stop mechanism may be attached to the connector housing and have a series of hinges that allow a latch stop to pivot into place, preferably locking with a latch, limiting movement of the latch and latch lock.

The latch and latch lock are thereby secured by the latch stop in a position engaging the latch lock with the second connector. This serves to provide improved connector position assurance.

The invention is described in further detail in the drawings and the detailed description below.

DETAILED DESCRIPTION OF THE INVENTION

Figure 1:
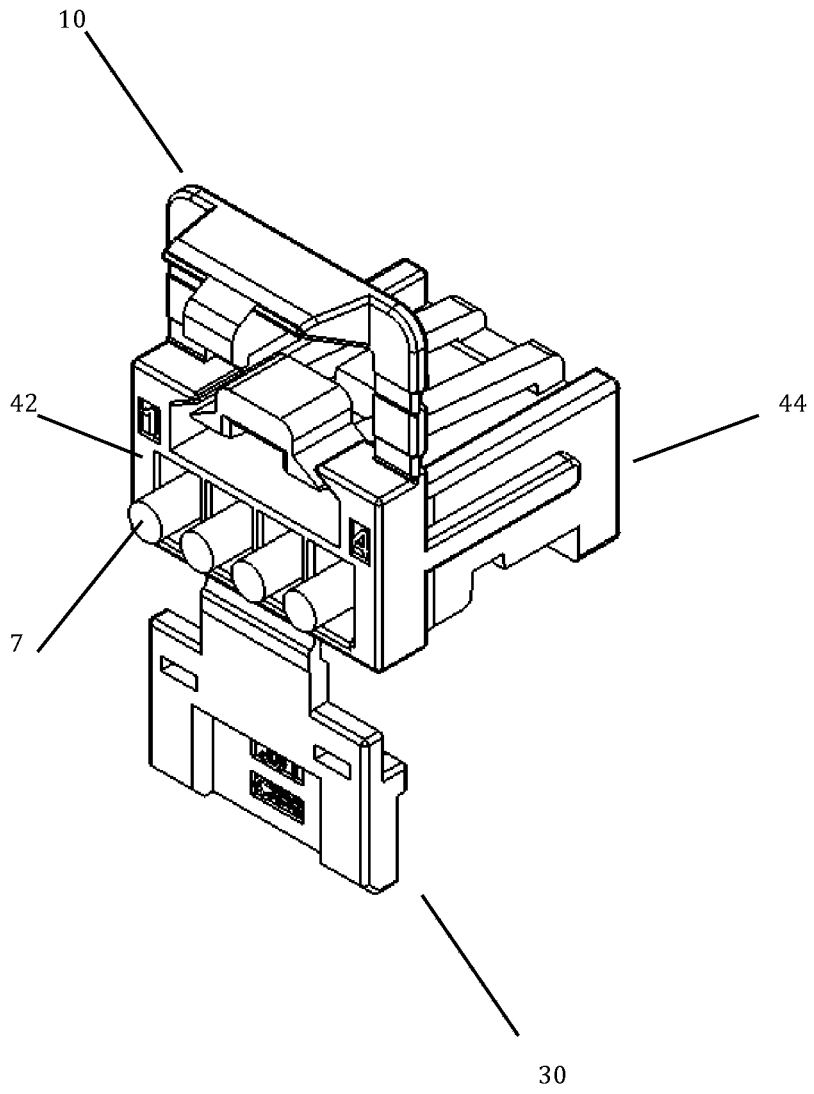
FIG. 1 is a perspective view of a female connector according to the present invention, with a latch stop mechanism and a terminal position assurance attached to the top and to the bottom of the female connector housing.

The present invention offers an improved connector position assurance mechanism. A connector system according to the present invention is illustrated in FIG. 1. A female connector is shown having a front 44 and rear 42. This particular variant has four wires 7. The improved connector position assurance of the present invention is provided by a latch stop mechanism 10 that may be attached to the top of the connector. A terminal position assurance 30 may be provided on the bottom of the connector.

Figures 2A, 2B, 2C:
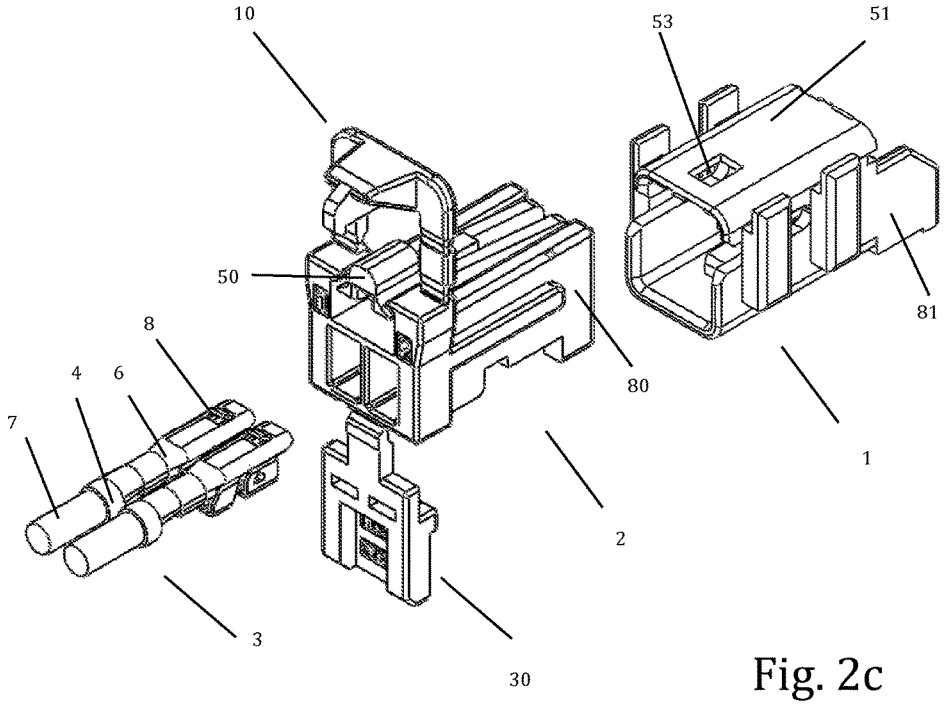
FIGS. 2*a*, 2*b*, and 2*c* are an exploded view of a terminal, female connector, and male connector, according to the present invention.

One embodiment of the invention shown in FIG. 2*b* comprises a connector housing 80, a latch 50 adjoining the connector housing, and a latch stop mechanism 10 adjoining the connector housing. This is a two-wire, (two-pin) variant, with the wire terminal 3 shown in FIG. 2*a*. A wire 7 passes through the wire crimp 4. The conductor passes through the core crimp 6. A terminal lock 8 comprises an inclined surface that may deflect as it passes the terminal lock catch 86, shown in FIG. 8, in the connector housing. When connected, the terminal lock 8 is secured by the terminal lock catch 86.

Connectors that may be used in the present invention include various types of connectors, but especially male and female connectors having housings. For a connector housing, the front of the housing may be considered the portion of the housing nearest the surface that mates with another connector.

The present invention may employ a latch 50 with a latch lock 54 to engage two connectors. A typical latch of the present invention may be seen in FIG. 7, and comprises a connection such as a hinge 52 to the connector housing. One or more beams 56 may extend from a hinge or hinges 52, supporting a latch lock 54. It is not necessary that the latch has a latch hinge, especially if the beam is sufficiently long and attached to the housing so that it may sufficiently deflect to engage or disengage the latch lock 54. The latch lock 54 may be rigidly attached to the latch beam 56, or it may be positioned so that it is not directly on the beam 56, but is supported by the beam 56 so that when the beam moves upward, the latch lock 54 also moves upward.

Figure 5:
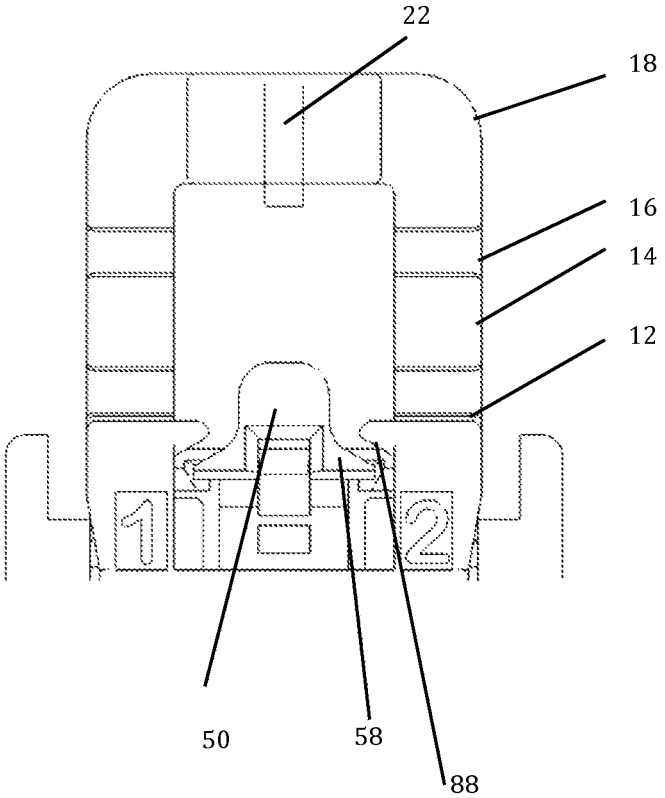
FIG. 5 is a rear view of the upper portion of a female connector of the present invention with a latch stop mechanism connected to the female connector housing.
Figure 7:
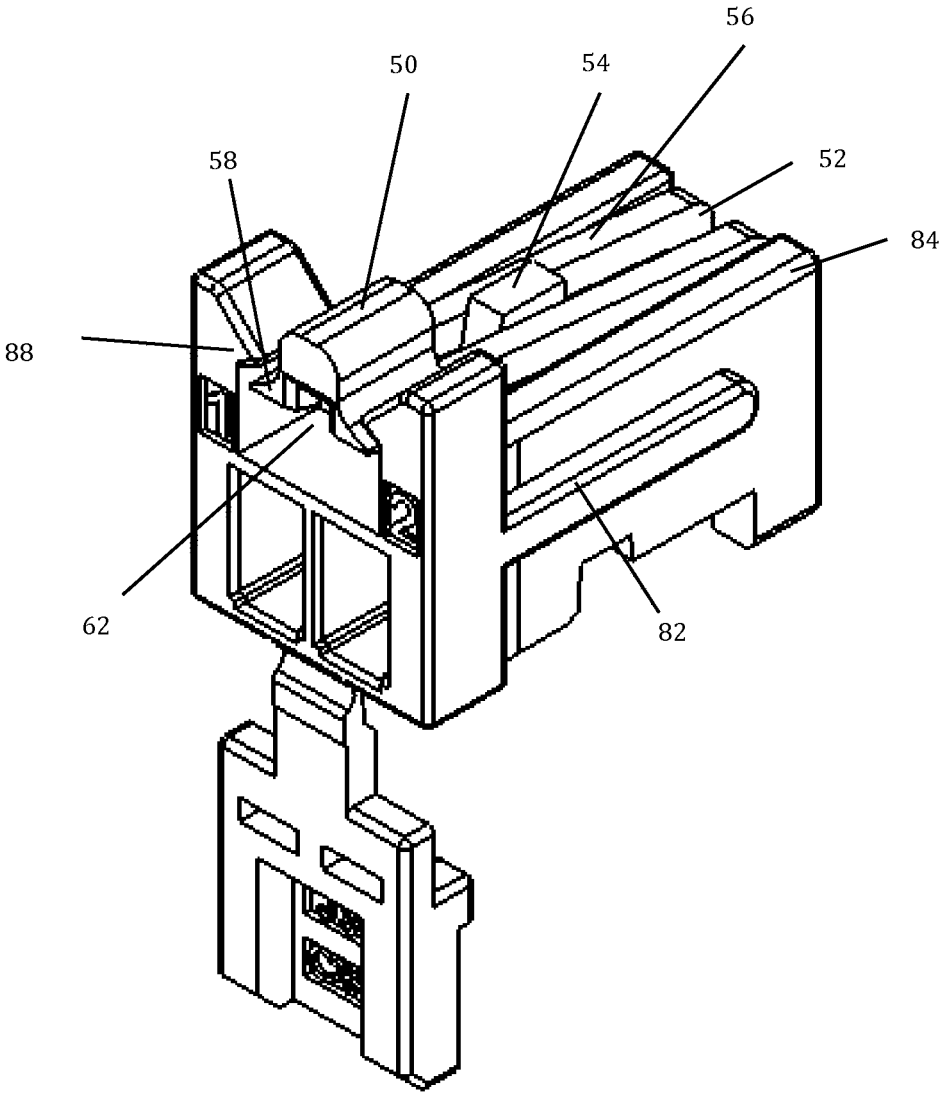
FIG. 7 is a perspective view of a female connector with an exposed latch and a terminal position assurance of the present invention.

The latch 50 of the present invention may also include a latch stop contact surface 66 to interact with the latch stop surface 68. The latch 50 may also have a cavity 62, as shown in FIG. 7, to facilitate movement of the latch stop arm 22 toward the latch stop contact surface 66. When the latch stop mechanism 10 is not engaged, the latch cavity 62 provides space into which the latch 50 may be depressed, allowing the connectors to be engaged or disengaged. Protrusions on either side of the cavity can provide overstress protection for the latch. As shown in FIG. 5, a latch overstress protection surface 58 on the latch and a latch overstress protection surface 88 on the female connector housing limit upward movement of the latch 50. Additional overstress protection surfaces may limit downward movement of the latch. A catch surface 64 may be included on the latch 50 to secure the locking surface of latch stop lock 26.

In the present invention, it is preferred that one connector have a latch lock 54 that may be engaged with a corresponding latch securing surface on the second connector. For example, a latch lock 54 may be depressed, deflecting the latch beam 56. A housing of a second connector may slide over the latch lock until a latch securing surface of the second connector housing is in position. The latch lock 54 may then be raised into contact with the latch securing surface. In a preferred embodiment of the present invention, the latch lock 54 may be positioned in a latch lock window 53 in the second connector housing. One or more sides of the latch window may serve as a latch securing surface.

The improved connector position assurance of the present invention operates to ensure that the latch lock 54 remains engaged with the latch securing surface. This is accomplished by employing a latch stop mechanism 10 that limits movement of the latch 50 and attached latch lock 54. A latch stop mechanism conveniently is attached to the connector housing in such a way that it may be manipulated to limit movement of the latch.

The latch stop mechanism 10 of the present invention may have a series of hinges and sections with a latch stop attached to a distal section. Preferably, the latch stop mechanism has a proximal hinge 12, a distal hinge 16, a proximal section 14 between the proximal hinge 12 and the distal hinge 16, a distal section 18 situated on a side of the distal hinge opposite the proximal section, and a latch stop disposed on the distal section.

It is preferred that sections 14 and 18 of the present invention are structural members sufficiently rigid to support a latch stop arm 22 and work in concert with the hinges 12 and 16. The sections may be planar or of any other suitable shape or construction.

The term "hinge" is intended to mean a moveable joint. The hinge of the present invention allows members of the latch stop mechanism to pivot around a portion of the connector housing. Preferably, movement is in one plane, so that the latch stop surface 68 remains in alignment as it moves toward the latch cavity 62 and arrives at the latch stop contact surface 66 of the latch. The hinges of the present invention serve to pivotably join two members, each member on an opposite side of the hinge. Accordingly, each hinge has two sides, each side corresponding to a member joined by the hinge.

In a preferred embodiment, one or more hinges of the latch stop mechanism 10 may be a live hinge. It is preferred that the latch stop mechanism 10 have at least two live hinges.

By bending the hinges of the latch stop mechanism 10, it is possible to position the latch stop arm 22 toward the latch cavity 62, and ultimately position the latch stop surface 68 against the latch stop contact surface 66 of the latch, so that the latch 50 cannot be deflected downward.

The latch stop mechanism 10 may comprise a latch stop arm 22 extending outward from the distal section 18 of the latch stop mechanism 10. The latch stop arm 22 may have a latch stop surface 68 and may also have a locking surface 28 to lock the latch stop surface into place. The term "latch stop" includes the latch stop surface 68 and the structure on which this surface is disposed. For example, the latch stop may include an arm, a wedge, or both. The latch stop may have one or more inclined surfaces, especially on or about the latch stop arm. Preferably, there is a wedge 24 projecting from the distal section 18 of the latch stop mechanism 10. The wedge 24 may be inserted into the latch cavity 62. The wedge 24 may assist pushing the lower surface of the latch 50 upward, and ultimately facilitate contact between the latch stop surface 68 and latch stop contact surface 66 of the latch.

When the latch stop contact surface 66 contacts the latch stop surface 68, movement of the latch 50 is limited. Thus, the latch lock 54 may not be disengaged from the latch lock window 53 unless the latch stop surface 68 is removed from the latch cavity 62. Further, in a preferred embodiment, the latch stop surface 68 may not be removed from the latch cavity 62 so long as the latch stop locking surface 28 remains in contact with a latch stop catch surface 64. Both the latch stop lock 26 on the latch stop and the latch stop catch surface 64 on the latch 50 may comprise inclined planes. An inclined plane on either the catch or lock surfaces may help guide the lock into place. Preferably, the latch stop lock 26 is disposed on the latch stop arm 22. The lock may have an inclined plane that guides the locking surface 28 toward the catch surface 64. The catch may have a corresponding inclined plane and corresponding catch surface.

The portion of the latch stop arm 22 that enters the latch cavity 62 may be shaped to facilitate entry into the latch cavity. The distal portion of the latch stop arm 22 may be rounded. Edges may feature chamfers.

In a preferred embodiment, a latch stop comprises a latch stop arm 22 and a latch stop wedge 24. The latch stop is centered on a distal section that is part of a hinged frame with two proximal hinges, two proximal sections, and two distal hinges. One result of this hinged frame is an opening through which the latch 50 may protrude when the latch stop mechanism is bent and the latch stop is positioned against the latch stop contact surface 66.

Figure 8:
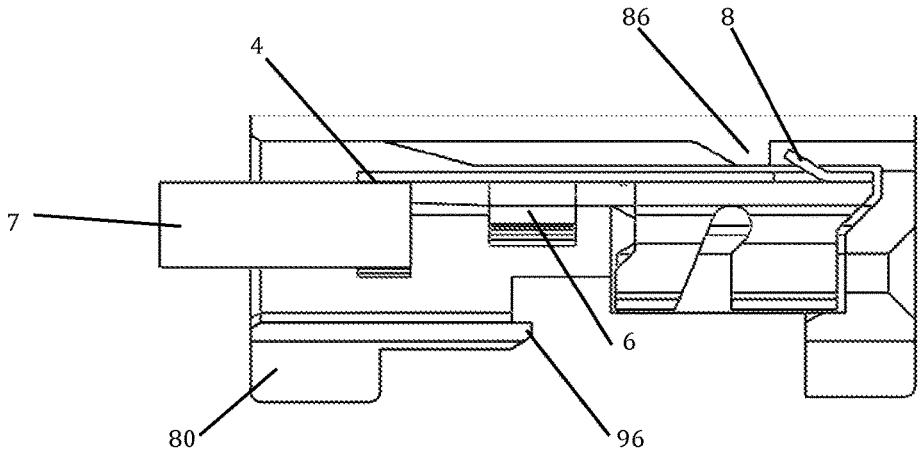
FIG. 8 is a longitudinal sectional view of a terminal inserted into a connector of the present invention.

FIGS. 2*a*, 2*b*, and 2*c* illustrate one such preferred embodiment. The wire terminal 3 of FIG. 2*a* is inserted into the wire cavities of the female connector 2 in FIG. 2*b*. A terminal 3 that is inserted and locked into a connector housing is shown in FIG. 8, with the terminal lock 8 in contact with terminal lock catch 86. When the terminal 3 is in place, a terminal position assurance catch 96 on the terminal is exposed and in position so that it may secure the terminal position assurance lock 36.

The male connector 1 in FIG. 2*c* is positioned so that the male connector housing 81 slides over portions of the female connector housing 80. A latch lock disposed on a latch beam may be depressed enabling the top wall 51 of the male connector housing to pass over the latch beams and latch lock on the female connector. When in position, the latch lock may pass through the latch lock window 53. The latch stop mechanism 10 may be contacted with the latch, limiting movement of the latch lock and securing it in place. Terminal position assurance 30 may be pivoted until lit locks with a catch on the terminal 3.

Figure 4:
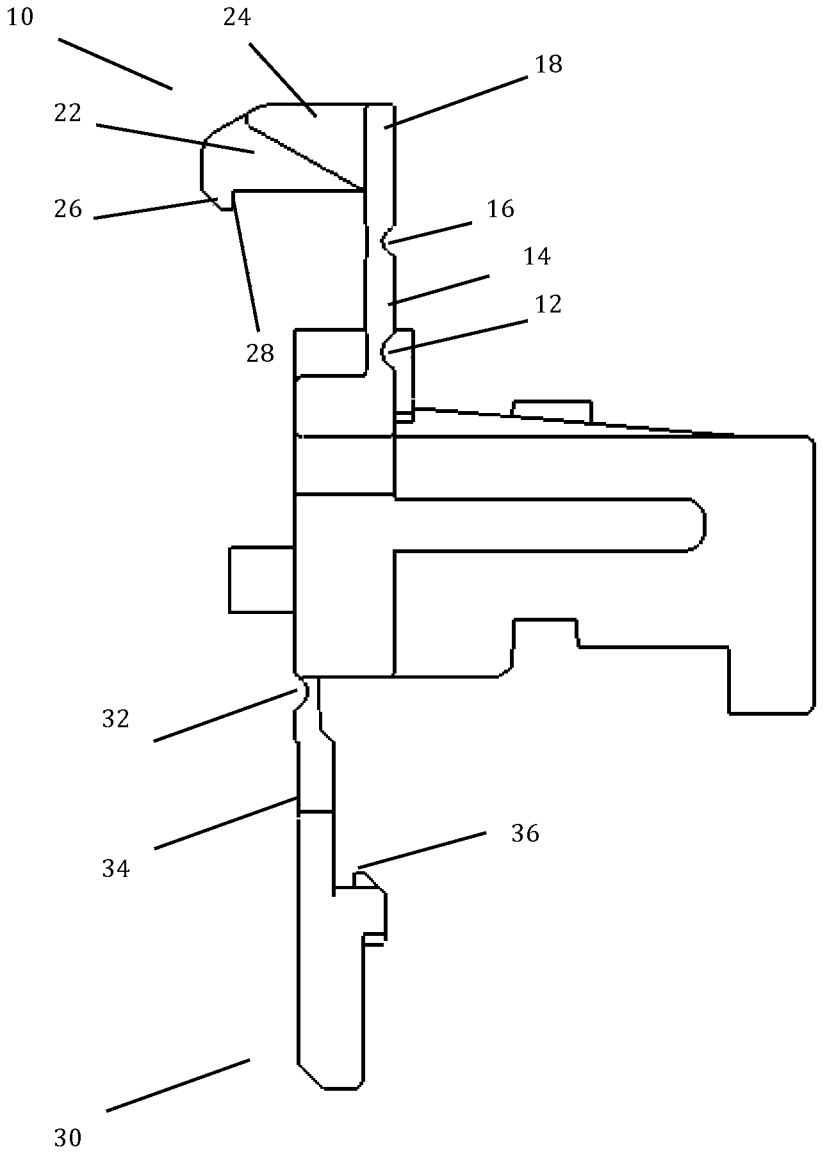
FIG. 4 is a side view of a female connector of the present invention with a latch stop mechanism and a terminal position assurance attached to the top and to the bottom of the connector housing.

FIG. 4 illustrates the structure of the terminal position assurance 30. Terminal position assurance hinge 32 is attached to the lower portion of the female connector housing. A terminal position assurance beam 34 is connected to the hinge 32 allowing the beam to pivot relative to the connector housing. A terminal position assurance lock 36 is positioned to contact a corresponding terminal position assurance catch on the wire terminal 96.

Figure 3:
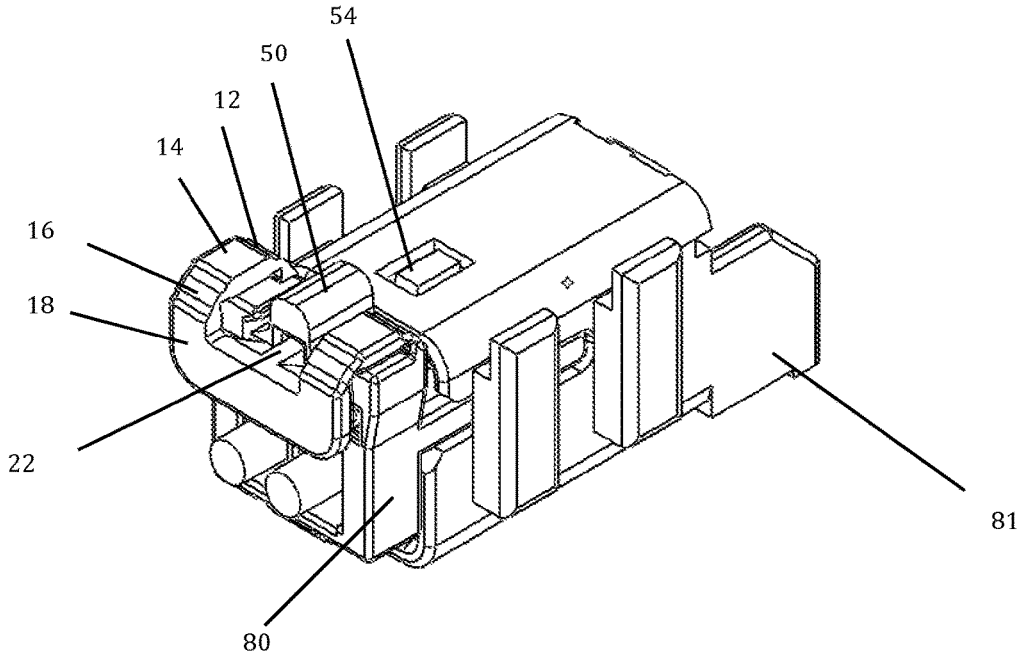
FIG. 3 is a perspective view of a male connector connected to a female connector according to the present invention, with a latch stop mechanism engaged with the latch.

FIG. 3 shows the connector position assurance of the present invention as used in a mated female and male connector system. Male connector housing 81 has been positioned over the female connector housing 80. The latch lock 54 is engaged with the latch lock window 53. The latch stop mechanism 10 has been bent using two sets of hinges, positioning the latch stop arm 22 in the latch cavity 62.

FIG. 4 shows further details of the latch stop mechanism of a preferred embodiment of the present invention. This view shows that the live hinges and the members they connect are continuous. The live hinges connect rigid members, all of which are made of the same injection molded material. At the position of the live hinge, there is a thinned or cut portion allowing the rigid members to bend along the hinge line. A proximal live hinge 12 is disposed on the top of the female connector housing. It is connected to the proximal section 14, which serves to extend the pivot point of the distal hinge 16. The position of the proximal hinge 12 on the connector housing near the top of the latch 50, and the length of the proximal and distal sections are optimized to allow the latch stop surface to contact the latch without the latch stop mechanism interfering with other structures of the connector housing or the wire terminal. The distal section serves to support the latch stop, which in this embodiment, includes the latch stop arm 22 and latch stop wedge 24.

Figure 6:
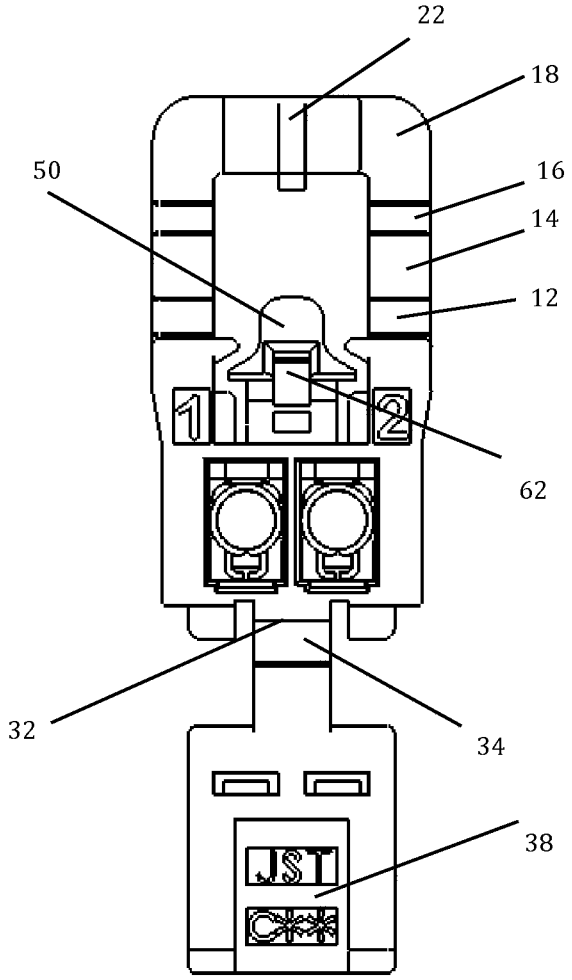
FIG. 6 is a rear view of a female connector of the present invention with a latch stop mechanism and a terminal position assurance connected to the female connector housing.

Front views in FIG. 5 and FIG. 6 further illustrate the latch stop mechanism of a preferred embodiment where the latch stop mechanism 10 comprises a hinged frame with an opening to accommodate latch 50. In FIG. 6, the anti-scooping feature 38 of the terminal position assurance is shown.

Figure 10:
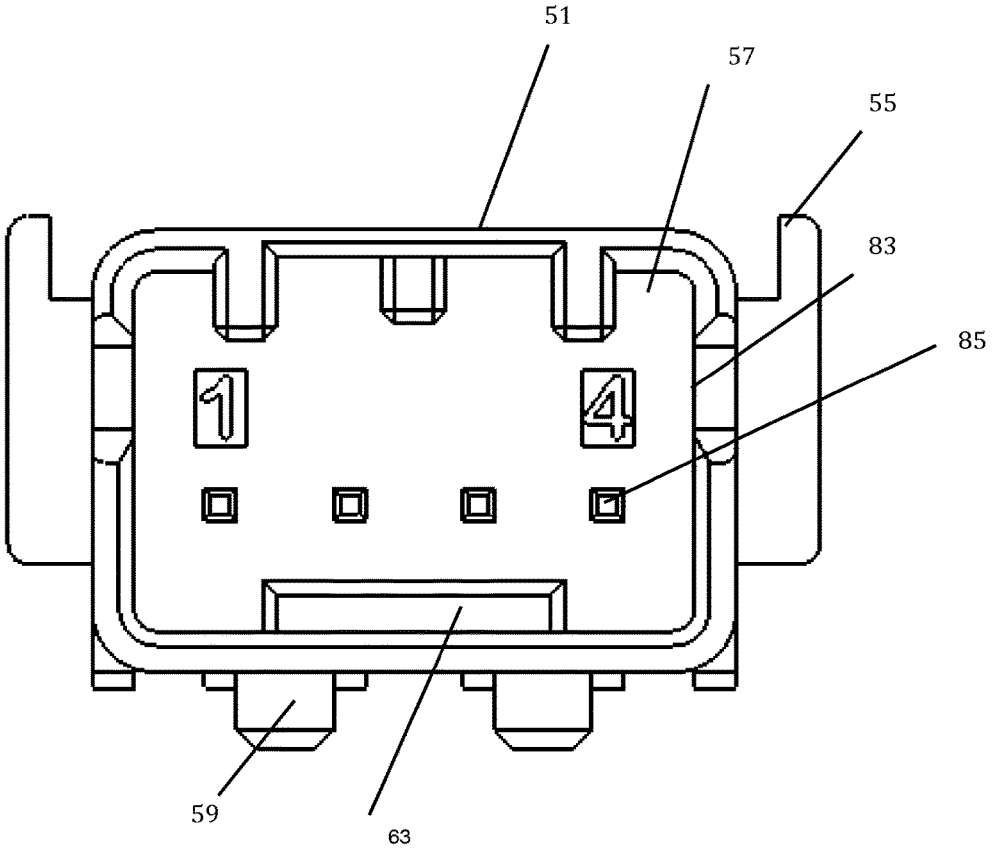
FIG. 10 is a front view of a male connector of the present invention.

FIG. 7 illustrates an embodiment of the present invention without the connector position assurance 10. In addition to more clearly showing the structures of the latch, FIG. 7 also shows keying feature 82 and polarization feature 84. These structures on the connector housing serve to align the female connector with the male connector. Corresponding features on the male connector housing are shown in FIG. 10, which depicts a polarization feature slot 57 and a keying slot 83. Also illustrated are the reinforcing tab 55, locating pin 59, and male connector anti-scooping feature 63. FIG. 10 additionally shows the pin 85 that may be inserted into the terminal. The male connector housing in FIG. 10 is a four-pin variant. The present invention may be applied to connectors of various types and sizes, including an suitable number of pins.

Figure 9A:
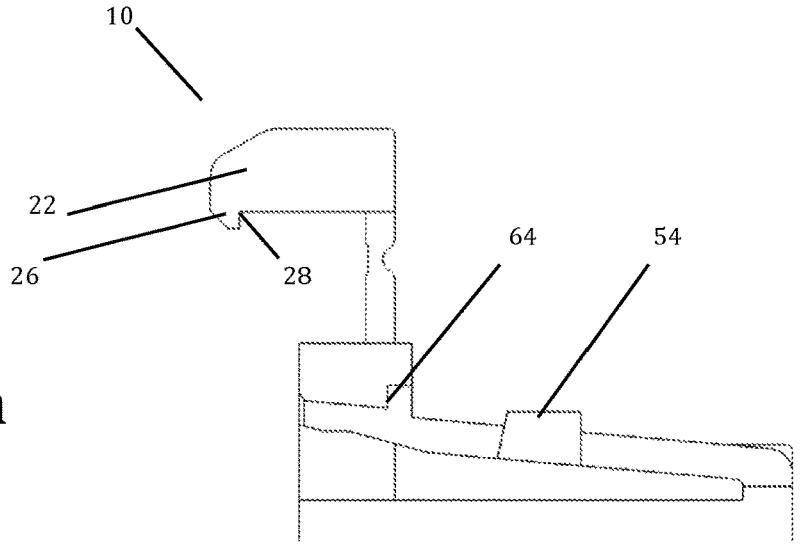
FIGS. 9*a*, 9*b*, and 9*c* are side views of the top portion of a connector of the present invention with a latch stop mechanism illustrated before, during, and after engaging with the latch.
Figure 9B:
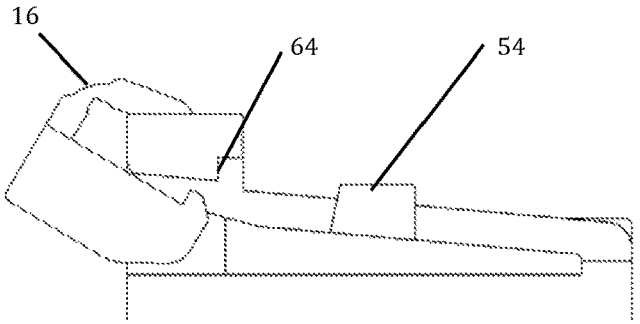
Figure 9C:
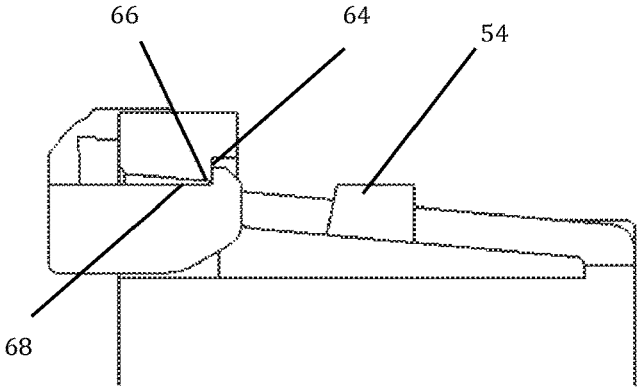

FIGS. 9*a*, 9*b*, and 9*c* demonstrate operation of the connector position assurance method of the present invention. A latch stop mechanism 10 initially extends away from the connector housing. The latch stop mechanism is moved by bending a proximal hinge and bending a distal hinge of a latch stop mechanism. The invention is not limited to a particular order of bending the hinges. As the hinges bend, the latch stop moves toward the latch and latch cavity. As the hinges bend further, the latch stop contacts the latch, more particularly the latch stop surface 68 comes into contact with the latch stop contact surface 66.

In a preferred embodiment, the latch stop is wedged against the latch stop contact surface 66. This does not necessarily mean that a wedge 24 is in contact with the latch stop contact surface 24. The latch stop locking surface 28 on the latch stop lock 26 locks with the latch stop catch surface 64.

In a preferred embodiment, a female connector, a terminal, latch, and latch stop are provided. The female connector is aligned with the male connector. The latch on the female connector is deflected and a latch lock on the female connector is engaged with a latch window on the male connector. A coupling surface on the latch lock is contacted with a latch securing surface on the latch window, causing the male and female connectors to be coupled.

The terms "coupled" and "coupling" as used herein are not limited to their technical definition in the electrical arts. Rather these terms are used according their general meaning in the way two objects, such as railroad cars, may be mechanically coupled. Thus, the male connector and female connector are coupled by the latch lock passing through the latch window, The operation of the latch stop mechanism, as shown in FIG. 9*c* prevents downward movement of the latch and latch lock, maintaining the latch lock in a coupled position.

The many features and advantages of the present invention are apparent from the written description and, thus, it is intended by the appended claims to cover all such features and advantages of the invention. Further, since numerous modifications and changes will readily occur to those skilled in the art, it is not desired to limit the invention to the exact construction and operation as illustrated and described. Hence, all suitable modifications and equivalents may be included as falling within the scope of the invention.

We claim:

1. A connector comprising: a connector housing, a latch stop mechanism adjoining the connector housing, and a latch adjoining the connector housing;

the latch stop mechanism comprising a proximal hinge, a distal hinge, a proximal section between the proximal hinge and the distal hinge, a distal section situated on a side of the distal hinge opposite the proximal section, and a latch stop disposed on the distal section; and the latch comprising a latch stop contact surface whereby when the latch stop contact surface contacts the latch stop, movement of the latch is limited.

2. The connector of claim 1 wherein: at least one of the distal hinge and the proximal hinge comprises a live hinge.

3. The connector of claim 1 further comprising: a wedge projecting from the distal section of the latch stop mechanism.

4. The connector of claim 1 wherein the latch stop comprises: an arm disposed on the distal section of the latch stop mechanism; and a locking surface disposed on the latch stop.

5. The connector of claim 1 wherein: the latch stop comprises an arm disposed on a wedge projecting from the distal section.

6. The connector of claim 1 wherein the latch comprises: a latch hinge; a latch beam extending from the latch hinge; a latch lock supported by the latch beam, the latch lock comprising a connector coupling surface.

7. The connector of claim 1 wherein the latch comprises: a latch hinge; a latch beam extending from the latch hinge; a latch lock supported by the latch beam; and a cavity corresponding to the latch stop.

8. The connector of claim 1 wherein the latch comprises: a latch hinge adjoining the connector housing; a latch beam extending from the latch hinge; a latch lock supported by the latch beam, the latch lock comprising a connector coupling surface.

9. The connector of claim 1 wherein the latch comprises a latch beam, a latch lock supported by the latch beam, the latch lock comprising a connector coupling surface;

wherein the latch stop comprises an arm disposed on the distal section of the latch stop mechanism, and a lock disposed on the arm; and wherein the latch stop, when in a locked position, limits movement of the latch lock.

10. The connector of claim 1 wherein the latch comprises a latch beam; a latch lock disposed on the latch beam, the latch lock comprising a connector coupling surface; and a catch surface;

wherein the latch stop comprises an arm disposed on the distal section of the latch stop mechanism, a lock disposed on the arm, and a locking surface disposed on the lock; and wherein the latch stop, when the locking surface is in contact with the catch surface, limits movement of the latch lock.

11. The connector of claim 1, the latch further comprising: a latch beam; a latch lock supported by the latch beam, the latch lock comprising a connector coupling surface; and a catch surface;

the latch stop comprising: an arm disposed on the distal section of the latch stop mechanism, a locking surface disposed on the arm; and wherein the latch stop, when the locking surface is in contact with the catch surface, limits movement of the connector coupling surface.

12. The connector of claim 1 further comprising:

a terminal position assurance locking mechanism comprising a beam, a hinge, an anti-scooping feature, and a lock.

13. The connector of claim 12, the terminal position assurance further comprising a terminal position assurance locking surface.

14. The connector of claim 12, the terminal position assurance further comprising: an anti-scooping feature.

15. A connector system comprising: a first connector and a second connector, the first connector operable to connect with the second connector;

the first connector comprising a first connector housing comprising a latch securing surface;

the second connector comprising a second connector housing, a latch stop mechanism, and a latch;

the latch stop mechanism comprising a proximal hinge, a distal hinge, a proximal section between the proximal hinge and the distal hinge, a distal section situated on a side of the distal hinge opposite the proximal section, and a latch stop disposed on the distal section;

the latch operable to selectively secure the first connector and the second connector in a connected position; and the latch stop mechanism operable to selectively limit movement of the latch.

16. The connector system of claim 15 wherein:

the latch comprises a latch stop contact surface that, when in contact with the latch stop, limits movement of the latch.

17. The connector system of claim 15 wherein:

the latch stop comprises an arm disposed on the distal section of the latch stop mechanism, and a locking surface disposed on the arm; and the latch comprises a latch beam, and a latch lock supported by the latch beam, such that when the latch lock is in contact with the latch securing surface, the first connector and the second connector are secured in a connected position.

18. The connector system of claim 17, the first connector housing further comprising a latch window; and wherein the latch securing surface is disposed on the latch window.

19. The connector system of claim 17 wherein a connector coupling surface is disposed on the latch lock, and when the connector coupling surface is in contact with the latch securing surface, the first connector and the second connector are secured in a connected position.

* * * * *